United States Patent [19]

Lytton et al.

[11] 4,009,803

[45] Mar. 1, 1977

[54] WEB FORMER

[75] Inventors: Kenneth G. Lytton; George J. Miller; James E. Donnelly, all of Gastonia, N.C.

[73] Assignee: Fiber Controls Corporation, Gastonia, N.C.

[22] Filed: Apr. 1, 1974

[21] Appl. No.: 456,981

[52] U.S. Cl. ..... 222/200; 19/105

[51] Int. Cl.[2] ..... B65G 65/70

[58] Field of Search ..... 19/105, 204, 205, 97.5, 19/261; 222/196.2, 200, 203; 214/17 A; 74/570, 571 R, 571 L, 571 M, 568 R; 198/200, 75, 58; 302/28, 29

[56] References Cited

UNITED STATES PATENTS

| | | | |
|---|---|---|---|
| 2,964,802 | 12/1960 | Aono et al. | 19/105 |
| 3,070,847 | 1/1963 | Schwab | 19/105 |
| 3,158,035 | 11/1964 | Biginelli | 74/571 X |
| 3,169,664 | 2/1965 | Meinicke | 19/105 X |
| 3,542,434 | 11/1970 | Harrison et al. | 19/105 X |
| 3,548,461 | 12/1970 | Reiterer | 19/105 |
| 3,728,759 | 4/1973 | Hergeth | 19/105 |
| 3,738,476 | 6/1973 | Hullet et al. | 198/58 |
| 3,750,235 | 8/1973 | Wise | 19/105 |

FOREIGN PATENTS OR APPLICATIONS

| | | | |
|---|---|---|---|
| 1,435,978 | 3/1966 | France | 19/105 |
| 401,773 | 5/1966 | Switzerland | 19/261 |

*Primary Examiner*—Dorsey Newton
*Attorney, Agent, or Firm*—Cushman, Darby & Cushman

[57] ABSTRACT

An improved web former for feeding a fiber web of dense material or the like to subsequent textile processing machinery. The web former disclosed incorporates an offset cam means comprising an eccentric sleeve concentrically rotatably journalled in a bearing assembly. The offset cam means oscillates a shaker plate between horizontal positions so that a web of uniform density and thickness may be compressed and moved downwardly through a chute defined by the shaker plate and a vertically extending wall to a plurality of fluted aluminum delivery rolls. The delivery rolls further assist in forming a web and transporting a web of fiber material to other textile equipment.

5 Claims, 6 Drawing Figures

Fig. 1
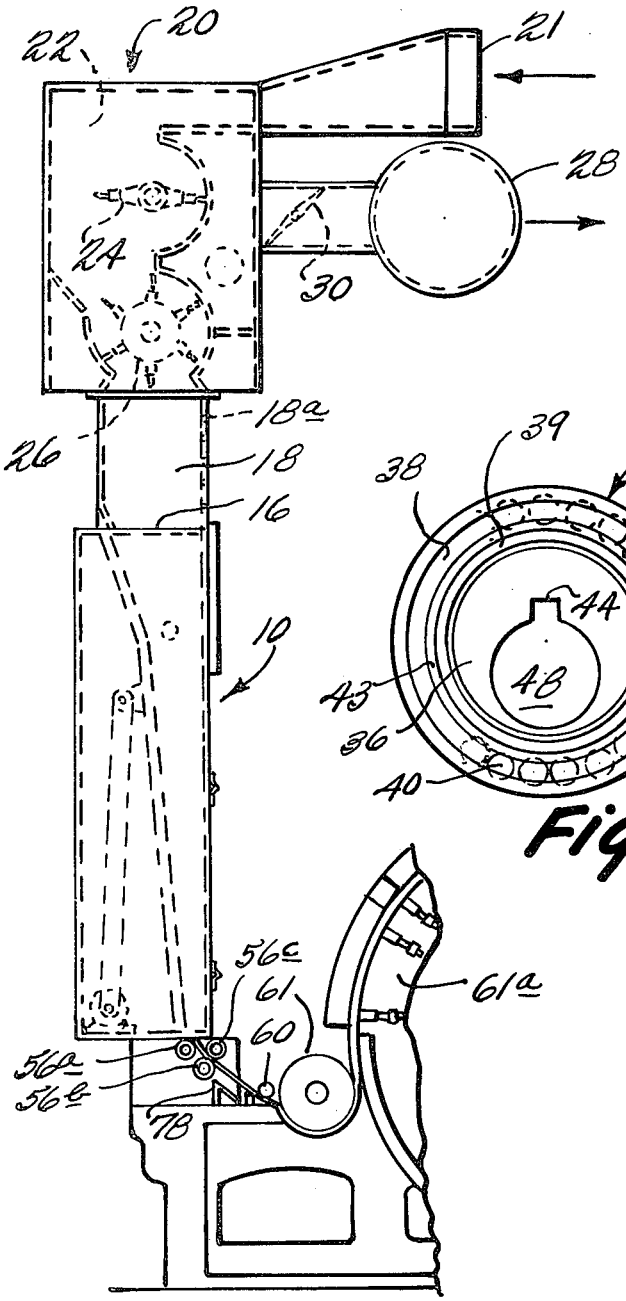
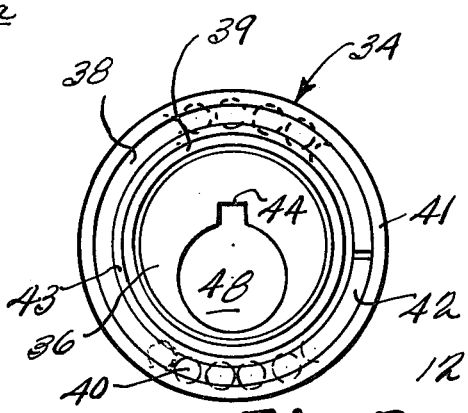
Fig. 2
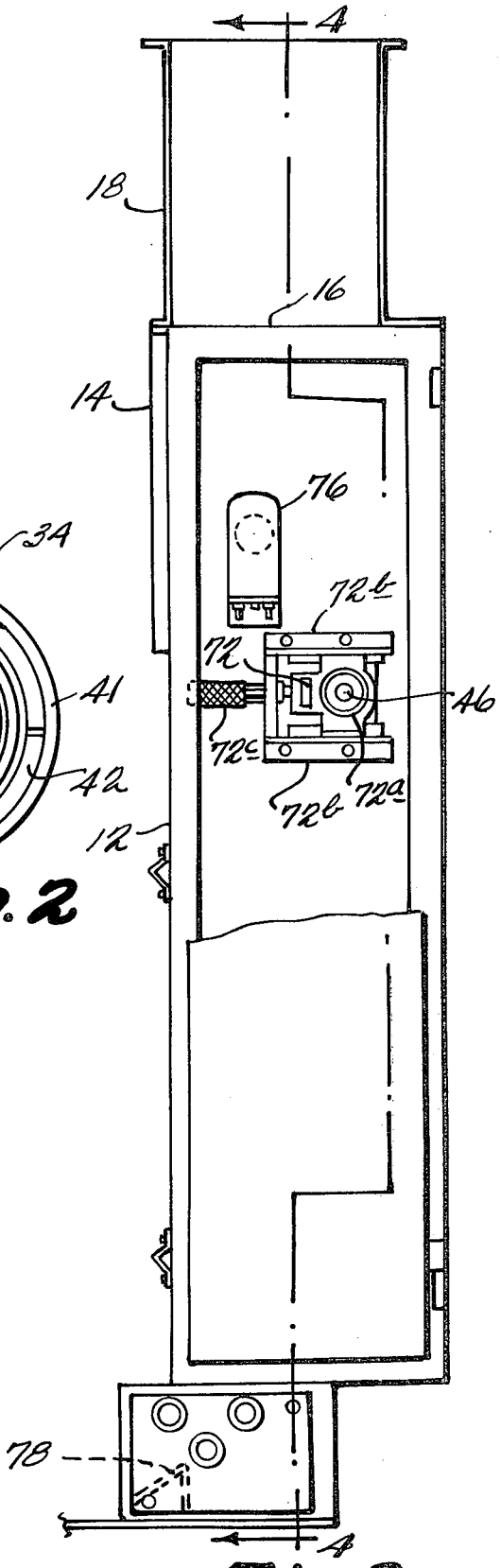
Fig. 3

WEB FORMER

BACKGROUND OF THE INVENTION

A. Field of the Invention

This invention relates to a device to feed fibers to a carding machine or the like, and more particularly to a web former having a shaker to compress open fibers down a chute to be delivered to subsequent textile equipment. The open fibers are fed downwardly into the chute by means of a distributor, condenser or separator. The movable shaker plate is displaced in a horizontal direction by an offset cam means. Located at the bottom of the chute are aluminum fluted delivery rolls which are driven by a card feed roll or the like. The card feed roll draws the compressed fiber through the fluted aluminum rolls to further transporting equipment which moves the fibers to other textile equipment for subsequent treatment of the textile fibers.

B. Description of the Prior Art

Devices for feeding a web of uniform density and thickness commonly referred to as web formers, are well known and have been described in the prior art. For instance, in U.S. Pat. No. 3,750,235 there is disclosed a web former which uses rolls to feed fibers onto a spiked inclined apron. The fibers are transported upwardly the spiked apron on a rotary comb which drops the fibers down a shaft. The shaft is formed by a front wall and a shaker plate. The shaker plate compresses the fibers introduced into the shaft and moves them downwardly to an outlet opening for feeding the fibers to subsequent textile equipment.

A drawback to U.S. Pat. 3,750,235 resides in the fact that the web former is unable to handle denser fibers such as pima, cotton, nylon or bleached cotton. Also, the movable shaker plate is moved by two shaker arms which are secured to shafts and which oscillate the shaker plate along a horizontal direction backwardly and forwardly. Such shaker arms require pivots and the corresponding structure is journalled in bearings. The present invention incorporates a rather simple offset cam which moves the shaker plate and also incorporates a bent shaker plate which facilitates the handling of denser fibers downwardly through the chute to fluted aluminum delivery rolls.

A fiber feeding device employing only a single arm and link at the bottom of the shaker plate is disclosed in U.S. Pat. 3,738,476. A pivot is secured to a casing and the shaker plate at an upward portion of the shaker plate. Once again, there is no disclosure in this patent of a bent shaker plate actuated by an offset cam means, nor is there disclosed a set of fluted aluminum delivery rolls for delivering the compressed fibers to a carding machine. Also, this patent utilizes as a method for placing fibers into the chute an apron with spikes to lift the fibers to a position such that they may be moved by a doffer downwardly through the inlet of the shaft.

A method and apparatus for distributing fiber material from a plurality of sources to a plurality of stations through a distributor is disclosed in U.S. Pat. No. 3,649,082. In this patent, one embodiment of the invention describes a distributing system which has a single station and a number of stations which can be fed only from one source, and second group of stations which can be fed from either source depending on the position of a ganged switch or switches.

SUMMARY OF THE INVENTION

It is, therefore, an object of the present invention to provide for a web former which is adapted to compress and move relatively dense fibers such as pima cotton, nylon or bleached cotton from a distribution source downwardly through a chute to be subsequently fed to a carding machine or other subsequent textile equipment.

Another object of the present invention is to provide a web former which employs an offset cam secured to a shaft drive by a motor which oscillates a shaker plate in the horizontal direction so that a column of fibers formed in the chute may be displaced through an outlet and transported by delivery rolls to a carding machine or the like.

A further object of the present invention is to provide for an offset cam means mounted on a rotatably driven shaft, the offset cam means being rotatably journalled within a bearing, so that the bearing surface contacts the movable shaker plate. With the offset cam means being rotated within the bearing by the driven shaft, an outer race of the bearing will contact the movable shaker plate but will be prevented from excessive sliding contact with the movable shaker plate. Therefore, there will be no excessive heat build up caused by the frictional rubbing of a cam surface on the movable shaker plate.

Another object of the present invention is to provide for a movable shaker plate which is bent along its surface near the inlet opening of the chute so that a wider chute is adapted to feed open fibers into a narrower chute.

Yet another object of the present invention is to provide for an adjusting means which may be manually adapted to provide for increased or decreased tension of a spring biased movable shaker plate on the outer race of the offset cam means.

Another object of the present invention is to provide aluminum delivery rolls which are located at the bottom of the chute and are driven by a card feed roll or the like. The aluminum delivery rolls are fluted and transport the compressed web of fibers over a feed plate to, for instance, a licker - in roller which feeds subsequent textile machinery. The aluminum delivery rolls are employed to improve the coefficient of variation of a web of fibers fed therethrough.

Another object of the present invention is to provide for a web former which may utilize a height extender on the top portion of the case so that additional material may be fed into the chute by a distributor, condenser or separator.

A further object of the present invention is to provide for an eccentric cam means of relatively simple design which may be rotatably driven on a shaft by means of a power source secured inside or outside of the casing. An internally arranged power source would save space outside the casing which may be employed for other purposes.

Additional objects of the present invention reside in the specific construction of the exemplary apparatus hereinafter particularly described in the specification and shown in the several drawings.

BRIEF DESCRIPTION OF THE DRAWINGS

Novel features of the improved web former in accordance with the present invention will be more readily understood from a consideration of the following description taken together with the accompanying drawings, in which a preferred adaptation is illustrated with the various parts thereof identified by suitable reference characters in each of the views, and in which:

FIG. 1 is a side view of the present invention showing a distributor for feeding the fibers into the web former and a subsequent carding machine;

FIG. 2 is a view of the offset cam means illustrating an eccentric sleeve concentrically rotatably journalled within a bearing assembly;

FIG. 3 is an enlarged view of the casing shown in FIG. 1;

DETAILED DESCRIPTION OF THE INVENTION

Figure 4:
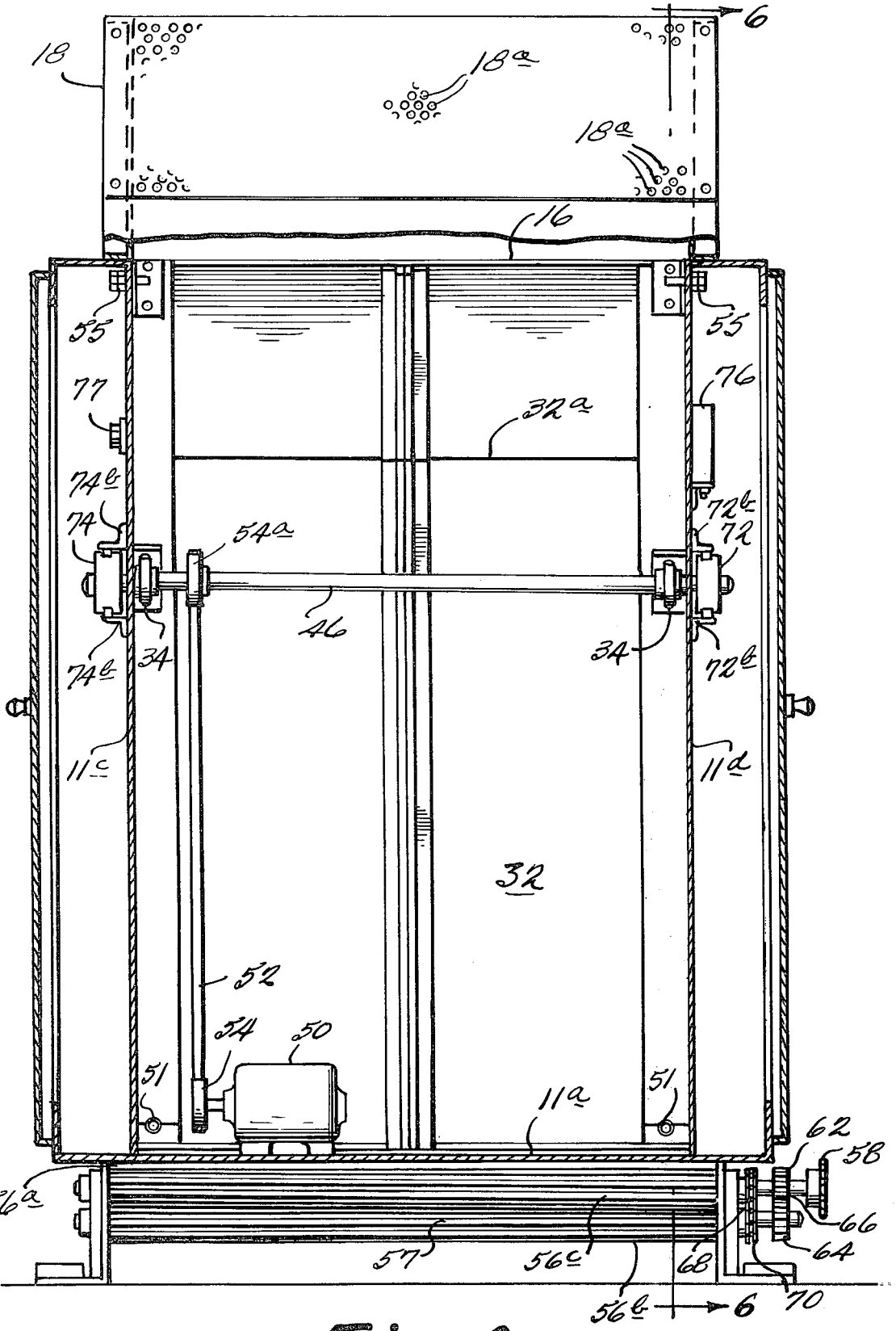
FIG. 4 is front view of the web former taken along lines 4—4 of FIG. 3.

The web former of the present invention is illustrated in combination with fiber feeding and withdrawing equipment. The distributor system as shown in the Wise U.S. Pat. No. 3,649,082 may be advantageously employed with the web former as disclosed in the present invention. U.S. Pat. No. 3,750,235 to Wise sets forth further features which may be employed with the present invention, and Wise U.S. Pat. No. 3,750,235 is incorporated herein by reference.

Now, referring to FIG. 1 of the drawings, there is shown an overall view of the web former of the present invention as it is employed in a distribution system for feeding a compressed web of fibers to a carding machine or other subsequent textile equipment. The web former is generally designated at 10, and may be constructed as having vertically extending sides constructed of metal or any suitable material. A front extending side 12 has a plexi-glass window 14 so that fibers dropped in through inlet opening 16 may be viewed by an operator. An upright height extender fiber 18 may be bolted or otherwise adequately secured to web former 10 adjacent to inlet opening 16. A distributor system, generally designated at 20; may be attached to the top of height extender 18 or attached directly adjacent to inlet opening 16 and to move open fibers by means of passageway 22 and rotary driven doffers 24 and 26 into inlet opening 16. An exhaust fan 28 employed in conjunction with a damper 30 is used to exhaust unrequired air particles. Other devices for moving open fibers into web former 10 may of course be used. By way of example, a condenser system such as disclosed in Lytton et al U.S. Pat. No. 3,039,149 or a separator as disclosed in Lytton et al U.S. Pat. No. 3,039,151 could be used to replace the distributor system of the present invention.

Figure 6:
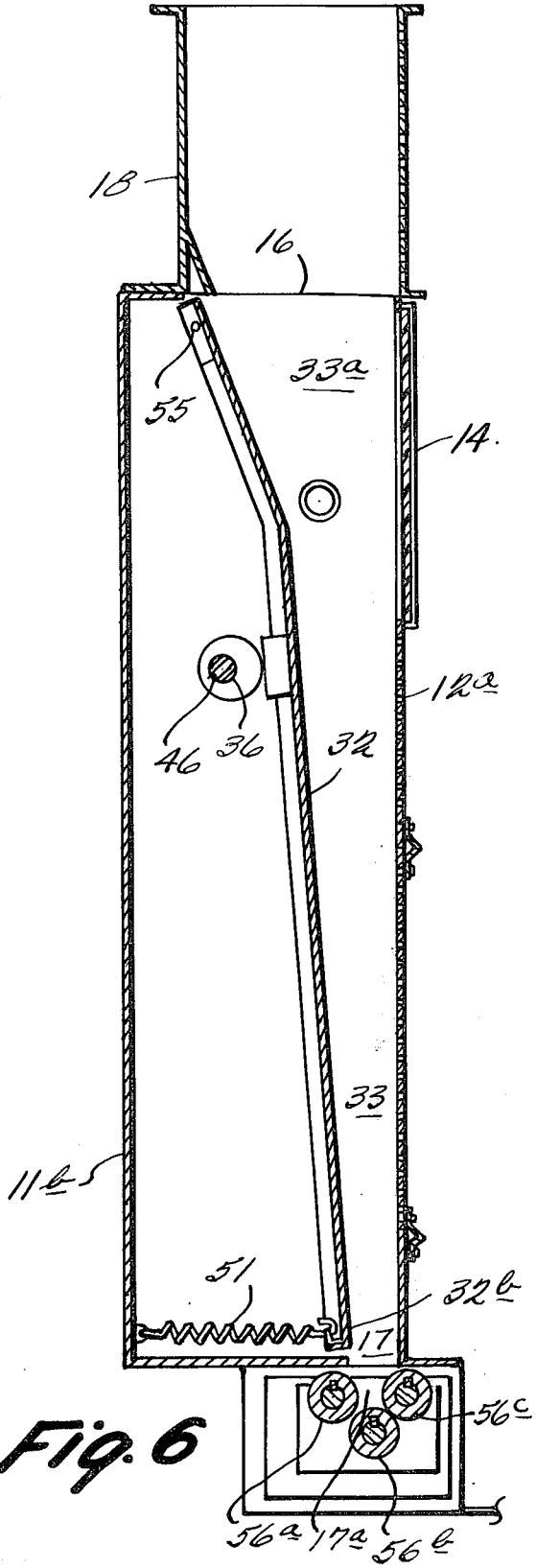
FIG. 6 is an internal view taken along lines 6—6 of FIG. 4.

With particular reference to FIGS. 2, 4 and 6, it may be seen that a movable shaker plate 32 may be oscillated in the horizontal direction by two offset cam means, generally designated at 34. Each offset cam means 34 comprises an eccentric sleeve 36 which is concentrically rotatably journalled within a bearing assembly 38. Eccentric sleeve 36 is secured within bearing assembly 38 by a press-fit to an inner race 39. Ball bearings 40 are located internally of bearing assembly 38 and between inner race 39 and outer race 41. A split O-ring 42 retains the ball bearings within a neoprene grease seal 43. Split O-ring 42 snaps into place and may be readily removed for repacking the bearings, etc.

A keyway 44 is provided so that each bearing assembly 38 may be secured to shaft 46. A small screw, for example one having an allen head (not shown), is used to secure the bearing assemblies 38 in their respective positions as may be seen from a viewing of FIG. 4.

Figure 5:
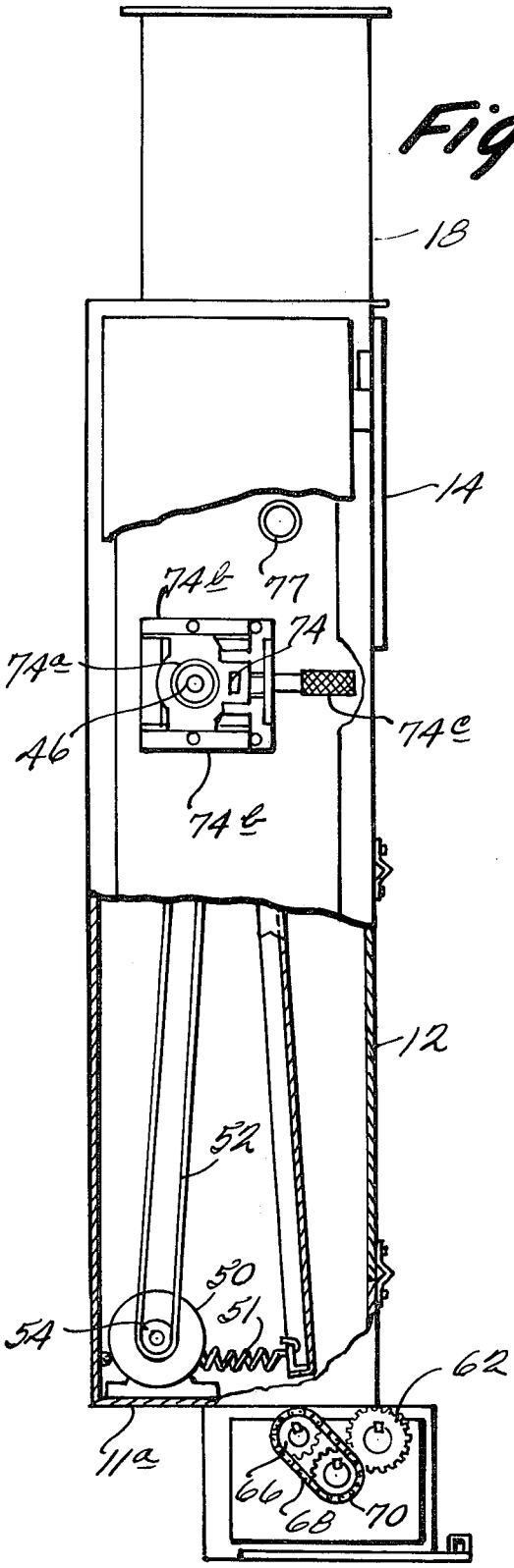
FIG. 5 is a view of the right side of the casing of FIG. 4.

With particular reference to FIGS. 4–6, it may be seen that shaft 46 is rotatably driven by a motor 50 and belt 52 and pulleys 54 and **54*a*. Motor 50 is rigidly secured to a bottom surface 11*a* of web former 10, but of course could be secured externally as shown in U.S. Pat. No. 3,750,235. A motor adapted to be inwardly secured saves space which is of critical importance in a crowded textile mill. With shaft 46 being adapted to be driven by motor 50, it is apparent that if movable shaker plate 32 is spring biased against the bearing assembly 38, movable shaker plate 32 will be displaced in a horizontal direction between maximum and minimum dimensions as shaft 46 rotates. A spring 51 is secured to vertically extending side 11*b* and is also secured at a bottom portion 32*b* of shaker plate 32. Shaker plate 32 is connected at its upward end by pivot joints 55 which secure shaker plate 32 to vertically extending sides 11*c* and 11*d***.

A non-limiting example will illustrate how offset cam means 34 is employed to vary the discharge opening. Assume that a minimum thickness dimension of 1 inch between bottom portion **32*b* and front side 12 from a rest dimension of 2½ inches is desired. If the diameter of the bearing assembly 38 is 3½ inches, then the center of aperture 48 must be offset three-fourths of an inch from the center of bearing assembly 38. The minimum discharge opening thickness will then be 1 inch and the maximum discharge opening thickness will be 4 inches as movable shaker plate 32** is displaced horizontally.

Another feature of the present invention resides in the use of a bend **32*a* formed across the surface of movable shaker plate 32. Bend 32*a* is preferably located above offset cam means 34 so that an upper chute 33*a* having a first tapered portion is channeled into a lower chute 33 having a second tapered portion. It has been found that the bend 32*a*** is necessary for handling fibers of denser material. Previously, the handling of denser fibers was attempted by employing a web former having a bend in the front side. Such a bend proved to be unsatisfactory because it interfered with the placement of the aforementioned viewing window. Further, the bend required that an additional structural member be secured to the front of the web former to add support.

Located adjacent to outlet opening 17 are three delivery rolls **56*a*, 56*b* and 56*c*. From FIGS. 5 and 6, it may be seen that the delivery rolls are driven by means of a sprocket 58 which is connected by a chain drive (not shown) to a driven card feed roll 60 or the like. As a card feed roll is rotatably displaced, sprocket 58 connected by means of gears 62 and 64 drives delivery rolls 56*b* and 56*c*. Delivery roll 56*a* has a sprocket 70 which is located on delivery 56*b*. Delivery rolls 56*a*, 56*b* and 56*c* are preferably constructed of aluminum and have 3-inch diameters. Further, the delivery rolls have a longitudinally fluted outer surface 57 which provides for a better gripping surface on a formed web. The delivery rolls extend substantially across the length of a formed web to transport a web to subsequent textile equipment, such as a card machine 61*a***.

It has been found desirable to provide for a means for adjusting the pressure of movable shaker plate 32 on bearing assembly 38. This may be accomplished by the use of a pair of micrometers 72 and 74 which are secured to vertically extending sides walls 11*c* and 11*d*. These 74*a* which rotatably journal driven shaft 46 to sides 11*c* and 11*d*. Bearings 72*a* and 74*a* are slidably engaged with support brackets 72*b* and 74*b* so that the position of offset cam means 34 may be adjusted relative to shaker plate 32. Micrometers 72 and 74 have adjustable handles 72*c* and 74*c* which may be screwed either inwardly or outwardly to move bearing assembly 38 either against or away from movable shaker plate 32. As a consequence of this adjustment, the bias of movable shaker plate 32 against bearing assembly due to spring 51 will be maintained so that shaker plate 32 is always responsive to the action of cam means 34.

Upper and lower chutes 33*a* and 33 provide for an effective compressing of dense fibers into a compact web of uniform density and thickness. Also, on sides 11*c* and 11*d* there is located a fiber height detector 76 which recognizes the height of a column of fibers and which may be adpated to either increase or decrease the rate of open fiber input through opening 16. Height detector 75 may be a radiation detector or a detector using lights, sound or ultra-sonic vibrations to ascertain the height of a column of fibers. Such height detectors are known in the prior art.

Disposed adjacently to and beneath fluted delivery rolls 56*a*, 56*b* and 56*c* is a feed plate 78 over which a uniform web passing outwardly through opening 17 may be fed across. Feed plate 78 provides for additional support for a web which is to be transported to a carding machine or other subsequent textile equipment.

The operation of the device employing the principles of the present invention will now be described. Dense open fibers such as pima cotton, nylon, bleached cotton or other textile materials such as cotton, rayon or dacron are fed through an opening 21 from a source (not shown) by means of air or fluid pressure. Fibers conveyed through opening 21 must be separated from the air stream and this is accomplished by means of a distributor system 20 and could also be accomplished by a condenser or a separator. After the fibers are introduced through opening 21 of the distributor, they are moved into an open area 22 where rotating doffer 24 knocks the fibers from the air stream and into the arm of a second doffer 26. The doffers 24 and 26 may be driven by any convenient means and may also be driven in the same manner as exhaust fan 28. Rotating doffer 26 catches the falling fibers and deposits them in height extender 18 through which fibers are fed into inlet opening 16 into the web former 10 which utilizes the fibers. Height extender 18 contains a plurality of apertures 18*a* on at least a front surface thereof so that air may be passed through the apertures which are sized to prevent escape of the fibers.

As the fibers fall into chutes 33*a* and 33, a considerable amount of air may remain among the fibers. As new fibers are dumped on top of previous fibers in the chutes, the air will be trapped in pockets between the fibers. As the shaker plate 32 moves inwardly, air is squeezed outwardly through apertures 12*a* disposed in front plate 12. As the air is squeezed outwardly through apertures 12*a*, and the fibers above fall by gravity aided by the weight of fibers above them into pockets from which the air has just been exhausted, further introduction of air is prevented when the shaker plate 32 moves back outwardly. As has been hereinbefore described, shaker plate 32 is actuated by offset cam means 34 which is secured to driven shaft 46. Because eccentric sleeve 36 is concentrically rotatably journalled within bearing assembly 38, outer race 41 moves inwardly and outwardly and correspondingly displaces movable shaker plate 32 inwardly and outwardly along a horizontal direction. Outer race 41 does not slide along shaker plate 32 as would an eccentric sleeve without a bearing assembly. An eccentric sleeve secured to a driven shaft which did not employ a concentrically rotatable bearing assembly would constantly rub against movable shaker plate 32 and would not only wear down the metal structure of the eccentric sleeve and/or the movable shaker plate, but would also generate undesired amounts of heat which could have an adverse affect on the fibers transported through chutes 33*a* and 33.

The process of feeding the fibers downwardly through chutes 33 and 33*a* and compressing them sidewardly under compressing forces from the movable shaker plate 32 causes the fibers to be tapered into a column of a uniform web which may then be displaced through discharge opening 17. The uniform web may then be fed and further formed by fluted aluminum delivery rolls 56*a*, 56*b* and 56*c*, through, for example, a licker-in roll 61 by means of a card feed roll 60 or the like. It is contemplated that the maximum horizontal opening along discharge opening 17 will be approximately 4–5 inches while the minimum opening will be 1 inch. This opening may of course be adjusted by providing for eccentric sleeve 36 and bearing assembly 38 of different sizes. As may be seen from a consideration of FIGS. 5 and 6, the bottom portion 32*b* of movable shaker plate 32 is arranged proximate to the center line of delivery roll 56*a*. As the offset cam means 34 displaces the movable shaker plate 32 between its maximum and minimum positions, movable shaker plate 32 enables a web to be compressed and fed downwardly through space 17*a* between the delivery rolls 56*a*, 56*b* and 56*c*. The fluted delivery rolls, being of approximately the same cross-sectional diameter, provide for an efficient means to further form and transport a uniform web of dense fiber material to the carding machine. Such an arrangement when used in conjunction with a bent movable shaker plate has been found to provide for a more desirable coefficient of variation, especially for denser materials such as pima cotton, etc. Previously, delivery rolls have been of a much larger size, i.e., approximately 6-inch rolls where it was thought for best results that one should be a card roll made of wood. The present invention contemplates the use of three fluted aluminum rolls arranged as previously described, wherein the results obtained provide a significant improvement over the prior art, i.e., approximately a 50% reduction in the coefficient of variation.

Thus, it is apparent that this invention has provided for all of the objects and advantages herein mentioned, along with others that will become obvious to one of ordinary skill in the art, to whom it will be apparent that the foregoing detailed description of the invention is subject to many modifications all of which are included within the scope and spirit of the appended claims.

We claim:

1. A web former for feeding fibers to a card or other subsequent textile equipment comprising:

means forming a downwardly tapered chute having a plurality of vertically extending sides forming at their upper ends an inlet opening for receiving open fibers and forming at their lower end a discharge opening of thickness smaller than said inlet opening so as to form in said chute a wedged shaped column of fibers having a given width and a downwardly tapering thickness, means adjacent said inlet opening for introducing open fibers from a source downwardly through said tapered chute, a height extending fiber chamber disposed between said introducing means and said inlet opening, said height extending chamber having a plurality of sides and having a plurality of apertures through at least one side of said chamber sides to permit removal of air while preventing the escape of fibers, said chute forming means including a movable shaker plate as one of said vertically extending chute sides, rotatable shaft means disposed adjacent to said movable shaker plate, offset cam means for shaking said fiber column down throughout its height by oscillating said movable shaker plate to vary said discharge opening generally in a horizontal direction between predetermined maximum and minimum thickness dimensions, said offset cam means comprising an eccentric sleeve secured to said rotatable shaft means and concentrically rotatably journalled within a bearing assembly comprising ball bearings sealed between an inner and outer race, said sleeve being secured to said inner race so that said sleeve may be rotated with respect to said outer race, means for adjusting said rotatable shaft means in a substantially horizontal direction relative to said shaker plate, said adjusting means enabling the bias of said movable plate against said bearing assembly to be selectively controlled and comprising at least one micrometer disposed adjacent said rotatable shaft means for selectively displacing said rotatable shaft means in a plurality of positions, means for biasing said movable shaker plate against said bearing assembly so that when said eccentric sleeve is rotated by said rotatable shaft means, sliding contact between said bearing assembly and said movable shaker plate is substantially eliminated during oscillation of said shaker plate, at least one of said vertically extending sides containing a plurality of apertures sized to prevent escape of fibers from said chute column while allowing the removal of air from the fiber column while said plate shakes the fibers under the urging of said offset cam means down said chute and compresses them into a compact web of uniform density and thickness available at said discharge opening and means adjacent to said discharge opening for withdrawing a uniform web from said chute and delivering the web to subsequent textile equipment including a plurality of delivery rolls each having a longitudinally fluted outer surface and each extending substantially across the length of a formed web, each of said delivery rolls also having substantially the same circular cross section and disposed adjacent to said discharge opening while being adapted to be rotatably driven so that a web may be transported between driven delivery rolls to subsequent textile equipment.

2. A web former as described in claim 1 wherein said fluted delivery rolls are constructed of aluminum.

3. A web former as described in claim 1 wherein a feedplate member is disposed beneath and forwardly of said fluted delivery rolls, said feedplate member providing support for a web which has been transported between said delivery rolls.

4. A web former as described in claim 3 wherein said movable shaker plate is provided with a bend across its surface, said bend defining an upper chute having a first tapered portion which channels into a lower chute having a second tapered portion.

5. A web former as described in claim 1 wherein said rotatable shaft means is adapted to be driven by a motor adjacent to said vertically extending sides.

* * * * *